US006915792B1

(12) United States Patent
Sheng

(10) Patent No.: US 6,915,792 B1
(45) Date of Patent: Jul. 12, 2005

(54) PAINTGUN WITH A REVOLVING DISC FOR FEEDING PAINTBALLS

(76) Inventor: Chih-Sheng Sheng, No. 100, Tzu Chiang W. Road, Kweishan Hsiang, Taoyuan Hsien (TW)

( * ) Notice: Subject to any disclaimer, the term of this patent is extended or adjusted under 35 U.S.C. 154(b) by 0 days.

(21) Appl. No.: 10/817,910

(22) Filed: Apr. 6, 2004

(51) Int. Cl.[7] ..... F41B 11/02
(52) U.S. Cl. ..... 124/48; 124/51.1; 124/74
(58) Field of Search ..... 124/48, 49, 50, 124/51.1, 73, 74

(56) References Cited

U.S. PATENT DOCUMENTS 1,358,125 A * 11/1920 Sturk ..... 124/29
1,404,689 A * 1/1922 Fairweather ..... 124/69
2,237,678 A * 4/1941 Lohr et al. ..... 124/66
2,709,426 A * 5/1955 Nove ..... 124/21
2,725,672 A * 12/1955 Marini ..... 446/407
3,782,359 A * 1/1974 Kester et al. ..... 124/48
3,855,988 A * 12/1974 Sweeton ..... 124/56
4,027,646 A * 6/1977 Sweeton ..... 124/56
5,522,374 A * 6/1996 Clayton ..... 124/59
5,816,232 A * 10/1998 Bell ..... 124/51.1
6,481,432 B2 * 11/2002 Rushton et al. ..... 124/49
6,578,565 B2 * 6/2003 Casas Salva ..... 124/73

* cited by examiner

*Primary Examiner*—John A. Ricci
(74) *Attorney, Agent, or Firm*—Rosenberg, Klein & Lee

(57) ABSTRACT

The invention relates to a paintgun having a barrel assembly with a barrel and a firing mechanism for paintballs; a trigger assembly connected with the barrel assembly for actuating the firing mechanism; and a revolving disc for feeding paintballs interposed between the barrel and the firing mechanism; a series of uniformly spaced paintball holes being formed at the rim of the revolving disc that is rotatable by a driving apparatus to bring the paintballs within the paintball holes to a discharge area coaxial to the barrel for discharging the paintballs; and a paintball adjacent to the revolving disc and the firing mechanism within the barrel assembly being provided for storing the paintballs disposed. Meanwhile, the paintball container includes a guiding slope for directing the paintballs into the paintball holes. The revolving disc with the paintballs is rotatable one after another to the discharge area.

4 Claims, 15 Drawing Sheets

PAINTGUN WITH A REVOLVING DISC FOR FEEDING PAINTBALLS

BACKGROUND OF THE INVENTION

1. Field of the Invention

The invention relates to an improved paintgun with a revolving disc for feeding paintballs, and more particularly, to a paintgun without the problems that the paintballs are stuck, hemmed and broken. Meanwhile, a paintball container and a barrel assembly are integrated in a body so as not to restrict the shooting sights of operators.

2. Description of the Related Art

Paintguns in different designs have been disclosed in TW 447697, TW 443486, TW 406894, TW 437941, U.S. Pat. Nos. 6,138,656, 6,003,504, 6,532,949, etc. A paintgun, as shown in FIG. 1, has a trigger assembly 11 above which a barrel assembly 12 is disposed. The barrel assembly 12 joins a barrel 13 at the front end thereof. A filler neck 14 sitting on the barrel assembly 12 is provided for connecting a paintball container 15. A pneumatic delivery mechanism 16 is disposed beneath the barrel assembly 12.

The paintball container 15 is located above the barrel assembly 12. Meanwhile, each paintball has a diameter of 17.5 mm so that the paintball container 15 must be large enough for accommodating a certain amount of paintballs. Accordingly, this structure will hamper the shooting sights of operators. To carry this bulky paintball container 15 in the simulated game of gun battle is a heavy burden for players.

Furthermore, the paintgun has been developed for a long while. The operators make a greater and greater demands on the discharge speed. The current discharge at the rate of 12–15 paintballs a second has failed to comply with the request of the players. The problem lies in that the paintballs B, as shown in FIGS. 2A–2D, pass through the filler neck 14 and falls to a discharge area 141. Thereafter, a small amount of airflow is released from the firing mechanism 121 of the barrel assembly 12 such that a delivery pipe 123 is slightly shifted to impart motion to a paintball B. Then a large amount of airflow swarms in an air chamber tube 122 to fire the paintball B. The delivery pipe 123 will be returned under the influence of resilience of a spring 124 to the original position shown in FIG. 2A. Accordingly, another paintball can be fired through the above-mentioned process. However, the discharge of a paintball B requires a reciprocating motion of the delivery pipe 123, thereby reducing the firing rate. In addition, the paintball B falls under the influence of gravity into the discharge area 141 at an uncontrolled and unstable rate such that the paintball B , as shown in FIG. 2E, is subject to breaking by the axial motion of the delivery pipe 123 when it is not fed in place. The paintball B is filled with oily liquid and pigment. When the paintball B is broken by impact of the delivery pipe 123, the discharge area 141 and the barrel 13 become dirty by the oily liquid with pigment. Besides, the paintball B can be stuck between the filler neck 14 and the discharge area 141. These are problems encountered frequently in the simulated games of gun battle. Consequently, the conventional paintgun leaves much to be improved.

SUMMARY OF THE INVENTION

It is a primary object of the invention to provide a paintgun with a revolving disc for feeding paintballs one after another into the paintball holes first. Thereafter, the paintball is carried to a discharge area to undergo the firing action. Unlike the conventional paintgun with falling paintballs in to-and-fro delivery way, the discharge rate of the invention can be therefore much improved to enhance the firepower.

It is another object of the invention to provide a paintgun with a revolving disc for precisely feeding paintballs in the discharge area so that the paintballs won't be stuck in the barrel and the malfunction rate of the paintgun can be reduced.

It is a further object of the invention to provide a paintgun whose paintball container and barrel assembly are integrated in a body such that the shooting sights of operators won't be restricted and the whole height of the paintgun is reduced for facilitating the operation of the paintgun.

BRIEF DESCRIPTION OF THE DRAWINGS

The accomplishment of this and other objects of the invention will become apparent from the following descriptions and its accompanying drawings of which.

DETAILED DESCRIPTION OF THE PREFERRED EMBODIMENT

Figure 1:
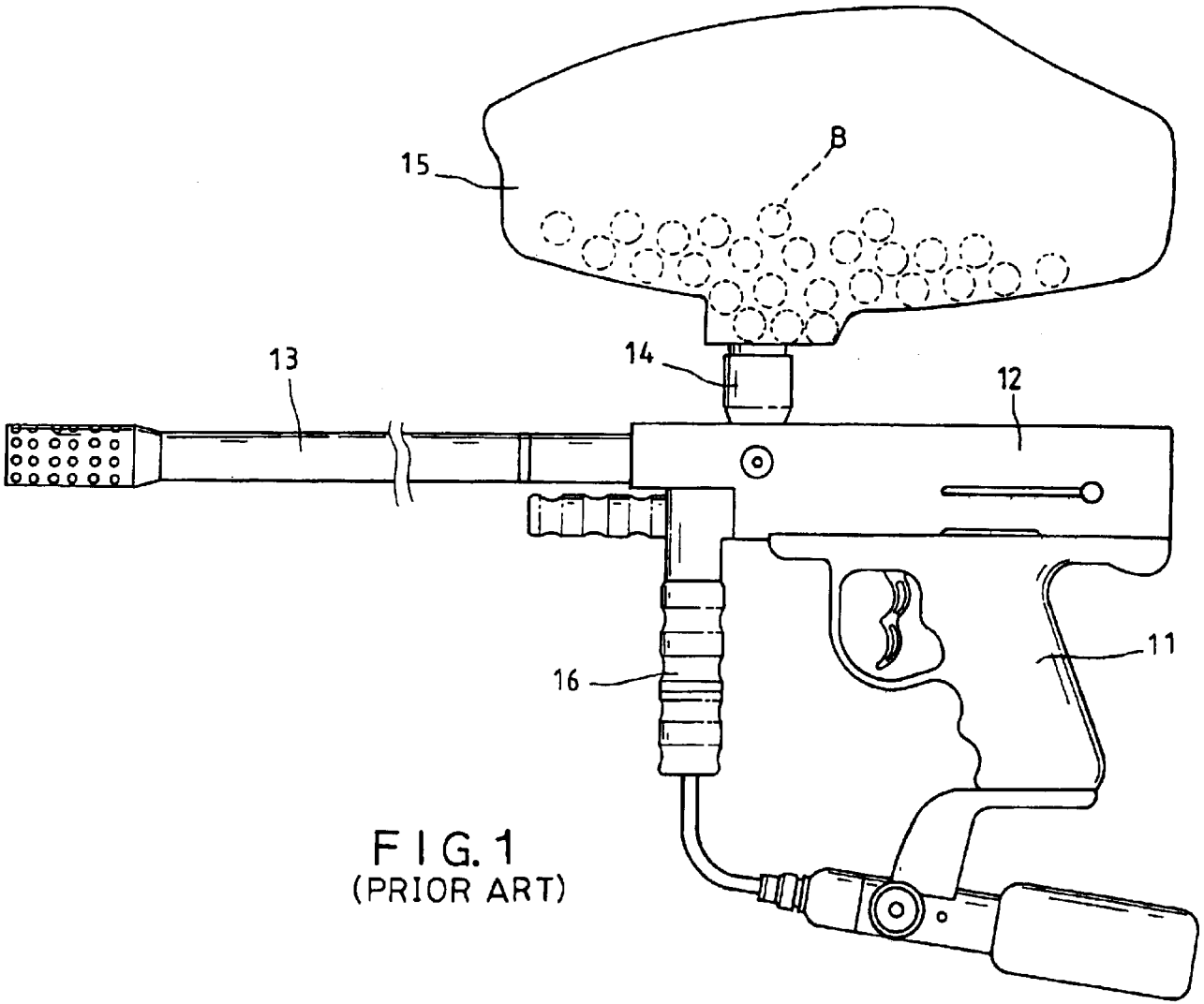
FIG. 1 (PRIOR ART)
FIG. 1 is a schematic drawing of a conventional paintgun.
Figure 2A:
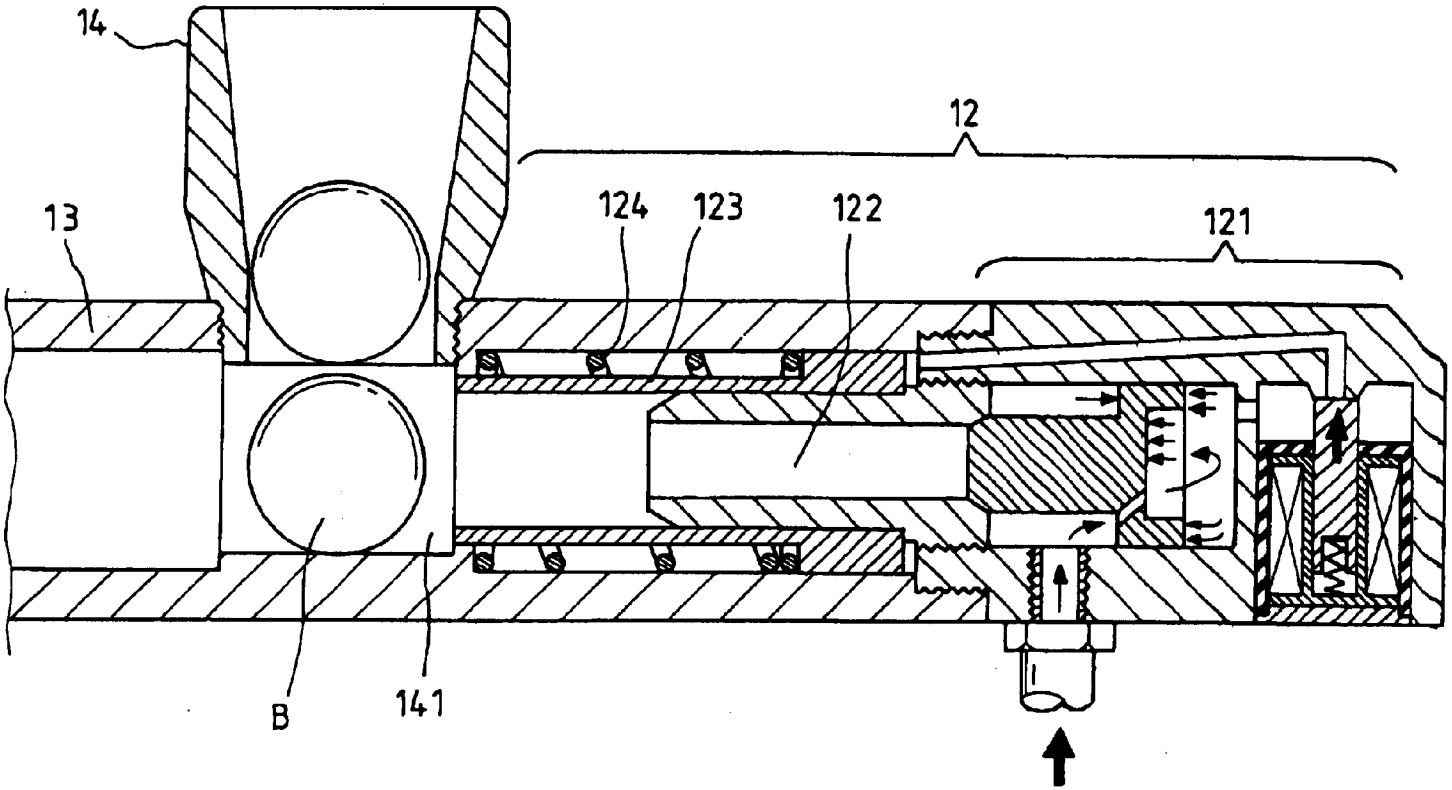
FIG. 2(A) (PRIOR ART)
FIG. 2A–2E are cutaway views of the invention wherein the feeding and discharging process of paintballs is illustrated.
Figure 2B:
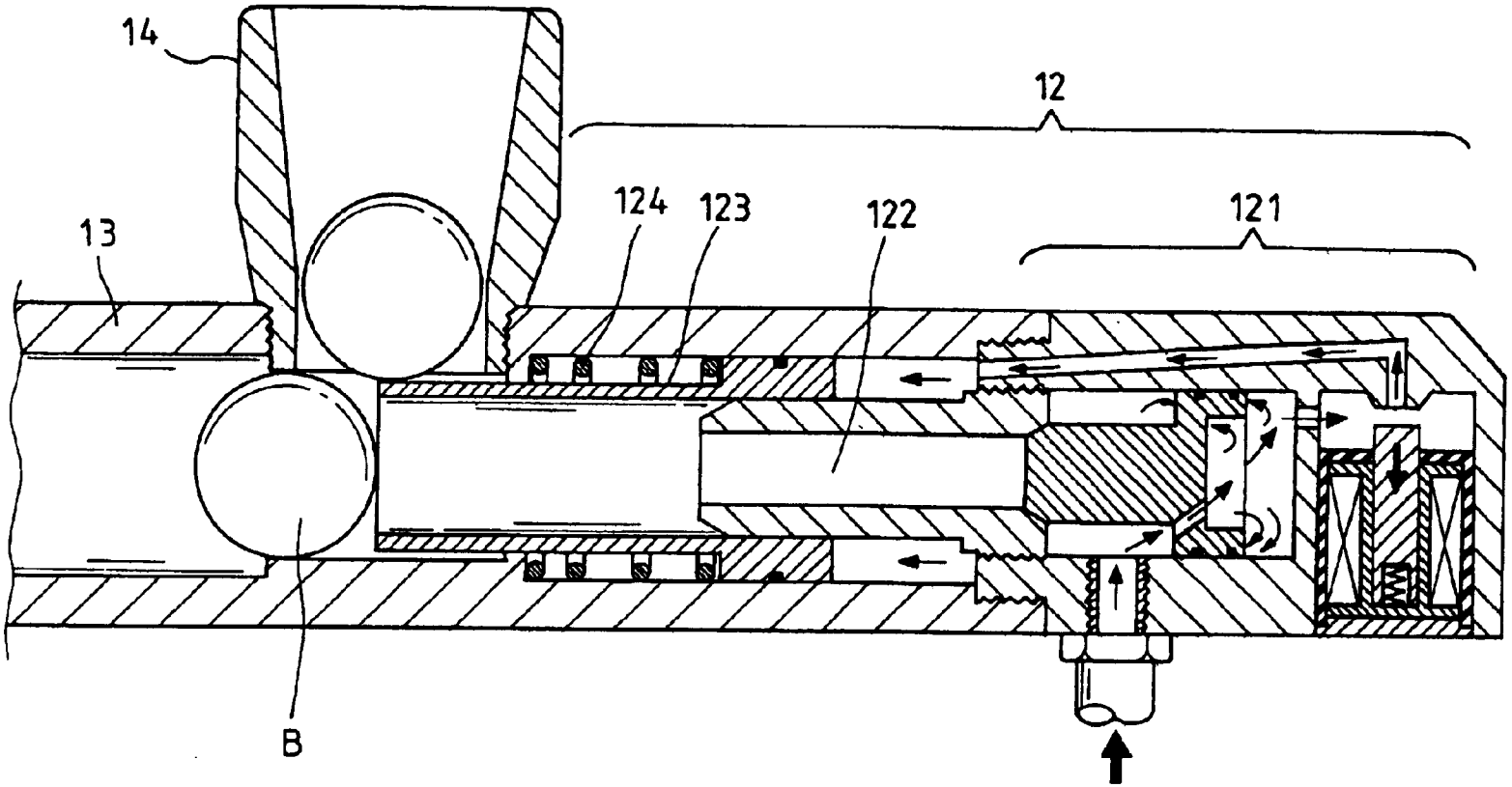
FIG. 2(B) (PRIOR ART)
Figure 2C:
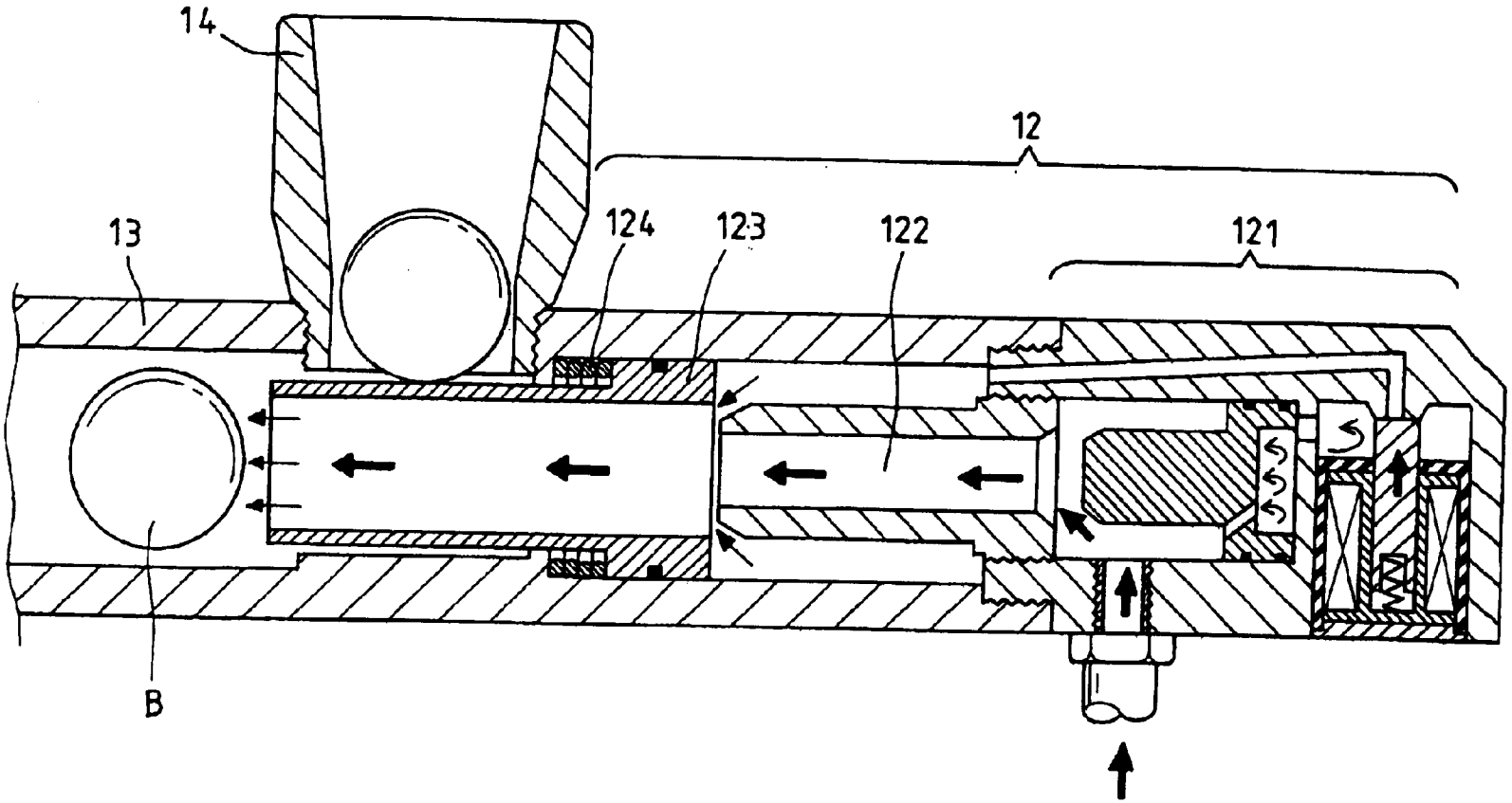
FIG. 2(C) (PRIOR ART)
Figure 2D:
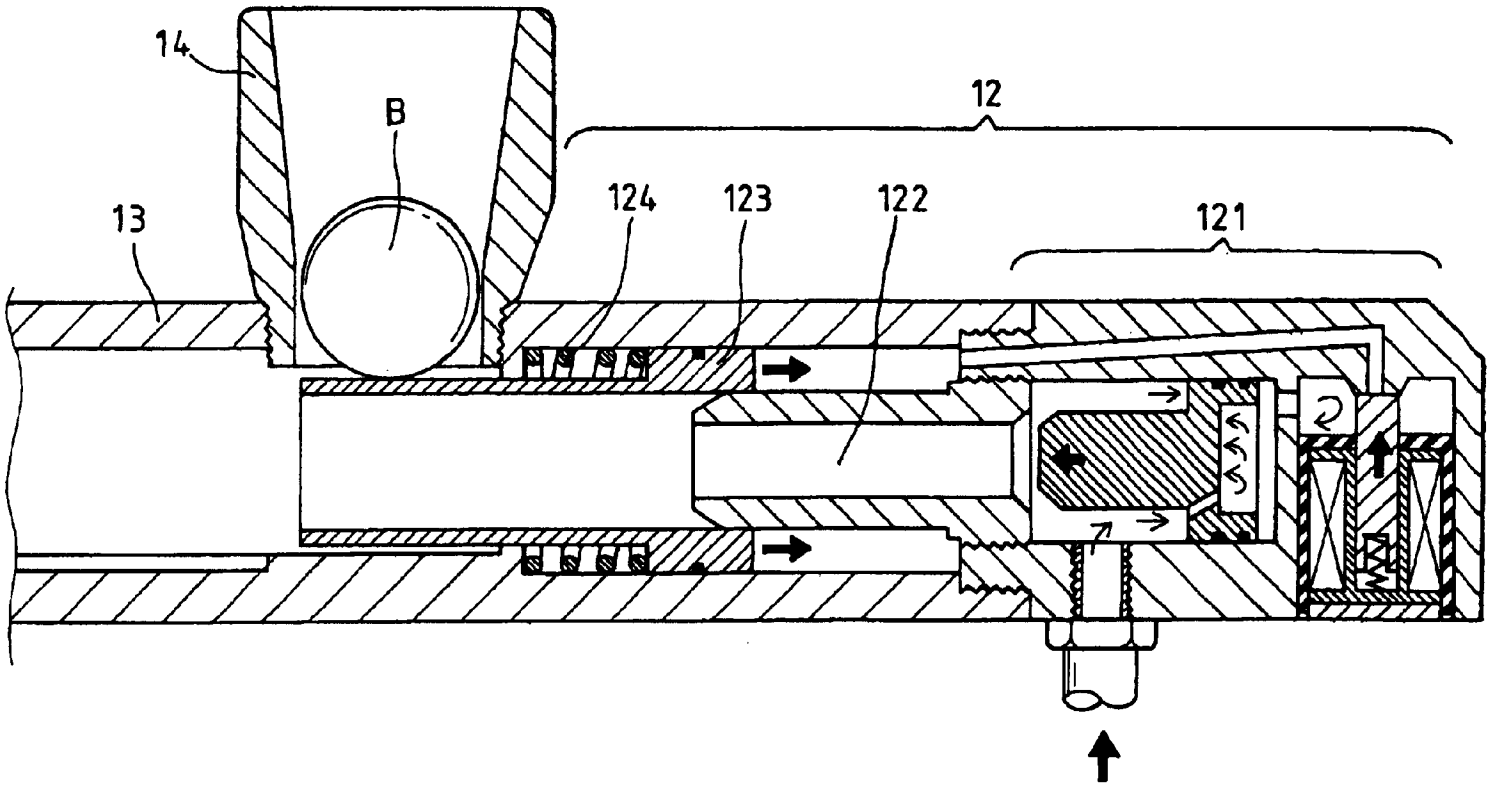
FIG.2(D) (PRIOR ART)
Figure 2E:
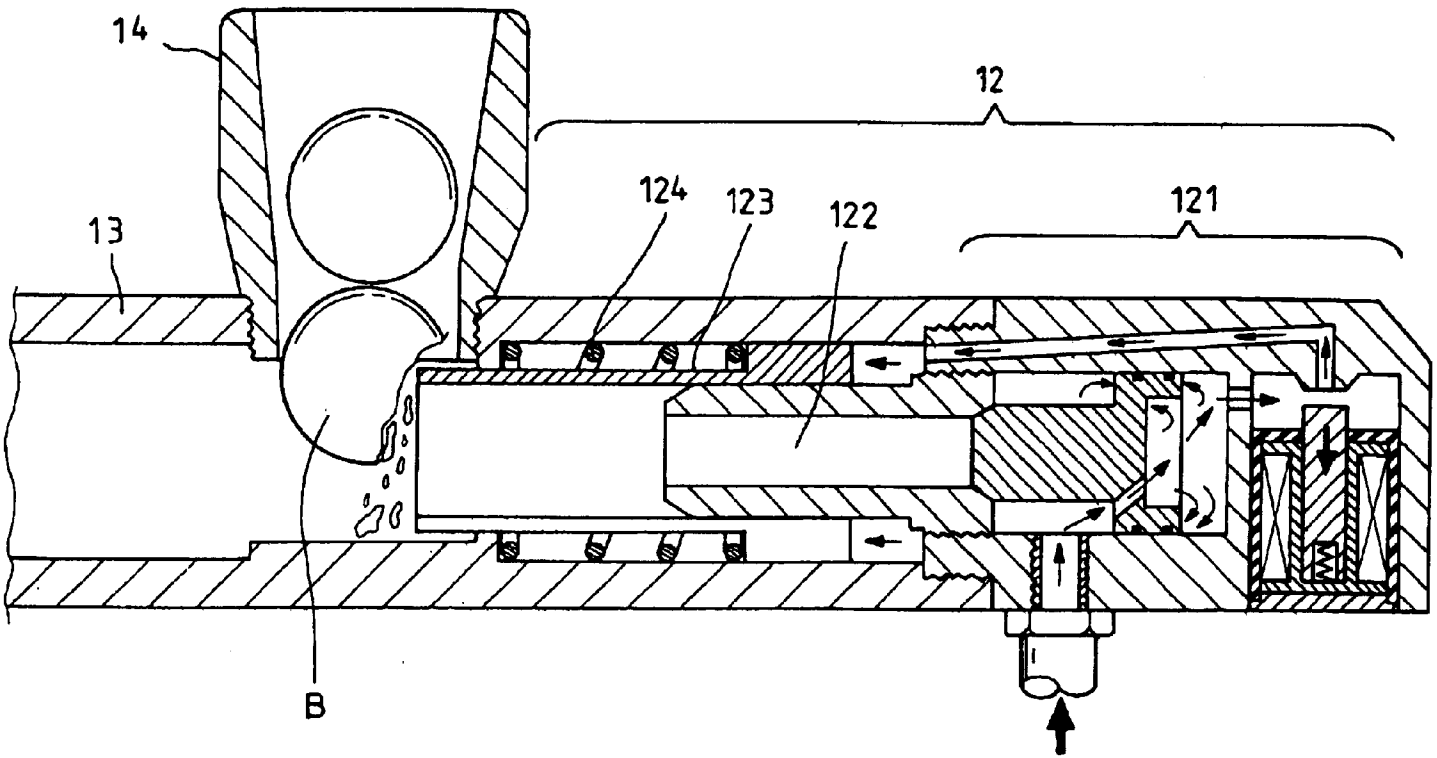
FIG.2(E) (PRIOR ART)
Figure 3:
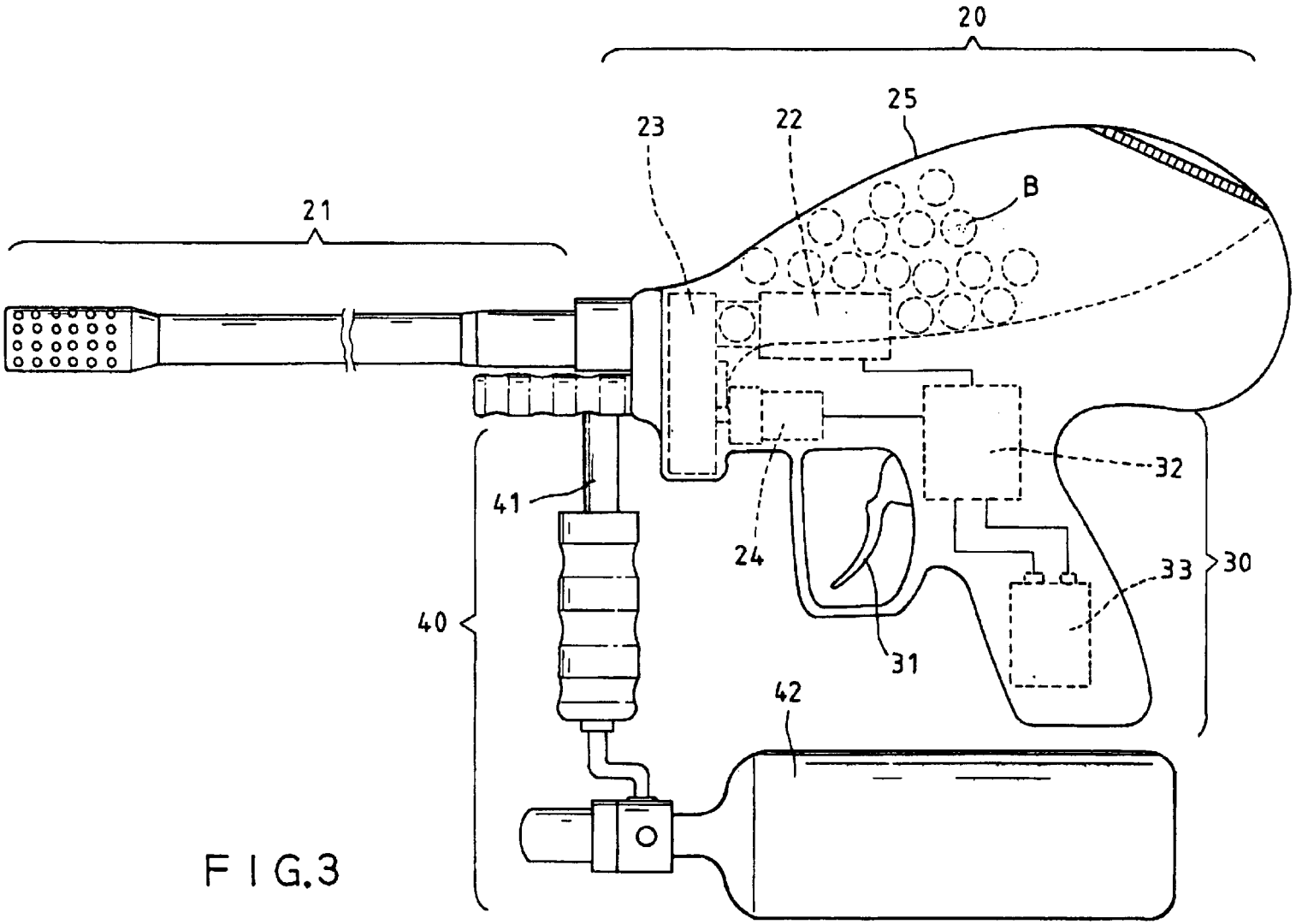
FIG. 3 is a schematic drawing of a paintgun in accordance with the invention.
Figure 4:
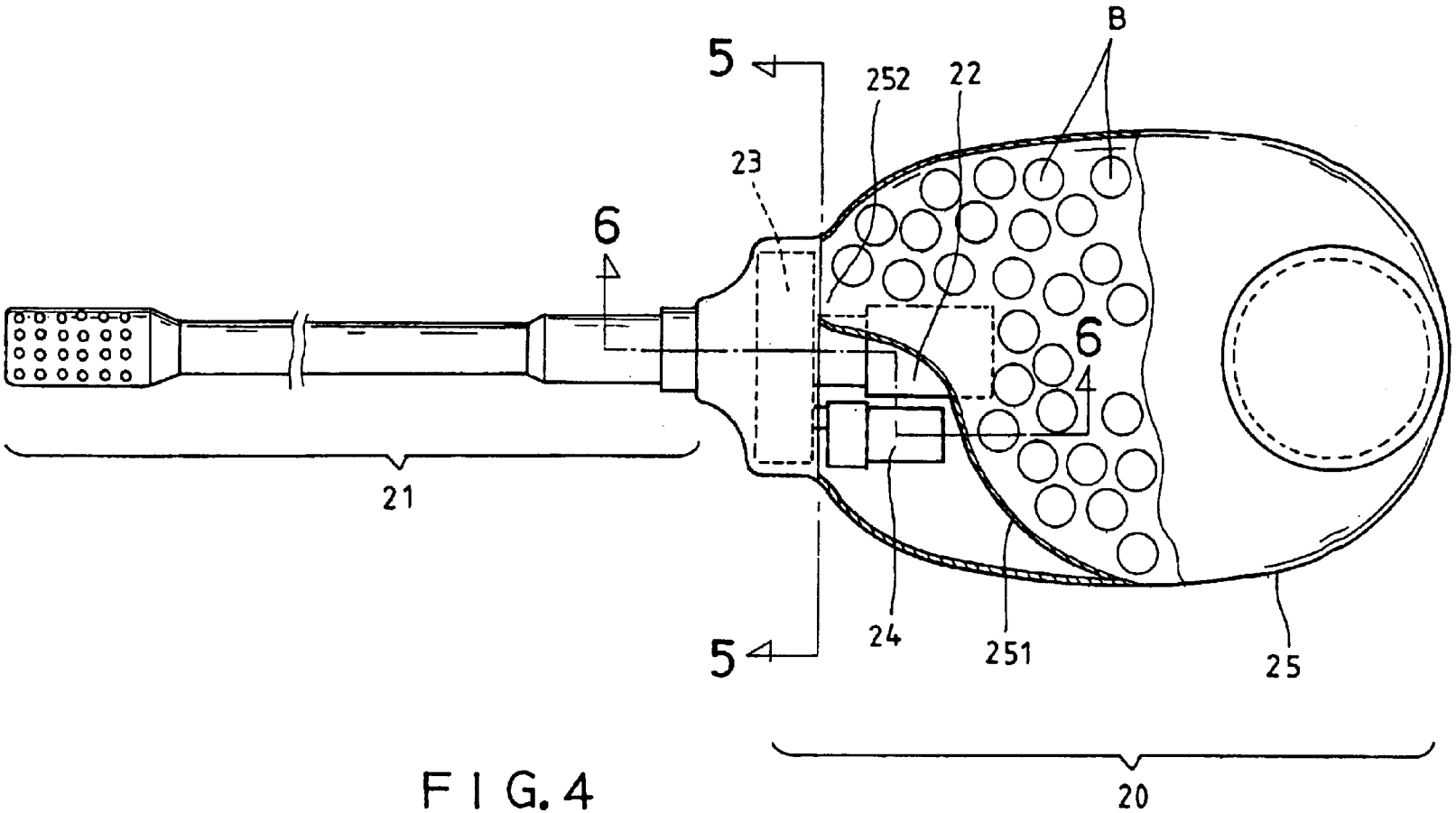
FIG. 4 is a top view of the paintgun in accordance with the invention.

First of all, referring to FIGS. 3 and 4, an improved paintgun of the invention is shown. The paintgun in accordance with the invention mainly includes a barrel assembly 20, a trigger assembly 30 and a pneumatic delivery mechanism 40.

The barrel assembly 20 includes a barrel 21 at the front end of thereof and a firing mechanism 22 for paintballs. The trigger assembly 30 in connection with the barrel assembly 20 includes a trigger 31, a firing circuit 32 and a battery 33. The pneumatic delivery mechanism 40 includes an air inlet pipe 41 to supply pressurized air from a steel bottle 42 to the firing mechanism 22. These components have been disclosed in U.S. Pat. No. 6,601,780 so that no further descriptions are given hereinafter.

The invention features a revolving disc 23 between the barrel 21 and the firing mechanism 22. As shown in FIGS.

5 and 6, a series of 25 uniformly spaced paintball holes 231 are formed at the rim of the revolving disc 23. The revolving disc 23 is rotated by a driving apparatus 24 to bring a paintball B within the paintball holes to a discharge area 26 coaxial to the barrel 21 for firing the paintballs.

Besides, the barrel assembly 20 includes adjacent to both the revolving disc 23 and the firing mechanism 22 a paintball container 25 for storing the paintballs B. The paintball container 25 has a guiding slope 251 at the bottom thereof for directing the paintballs B into the paintball holes 231 of the revolving disc 23. Then, the revolving disc 23 with the paintballs B is rotated to the discharge area 26 such that the paintballs B within the discharge area 26 can be fired one after another by the firing mechanism 22 from the barrel 21 of the paintgun.

Figure 5:
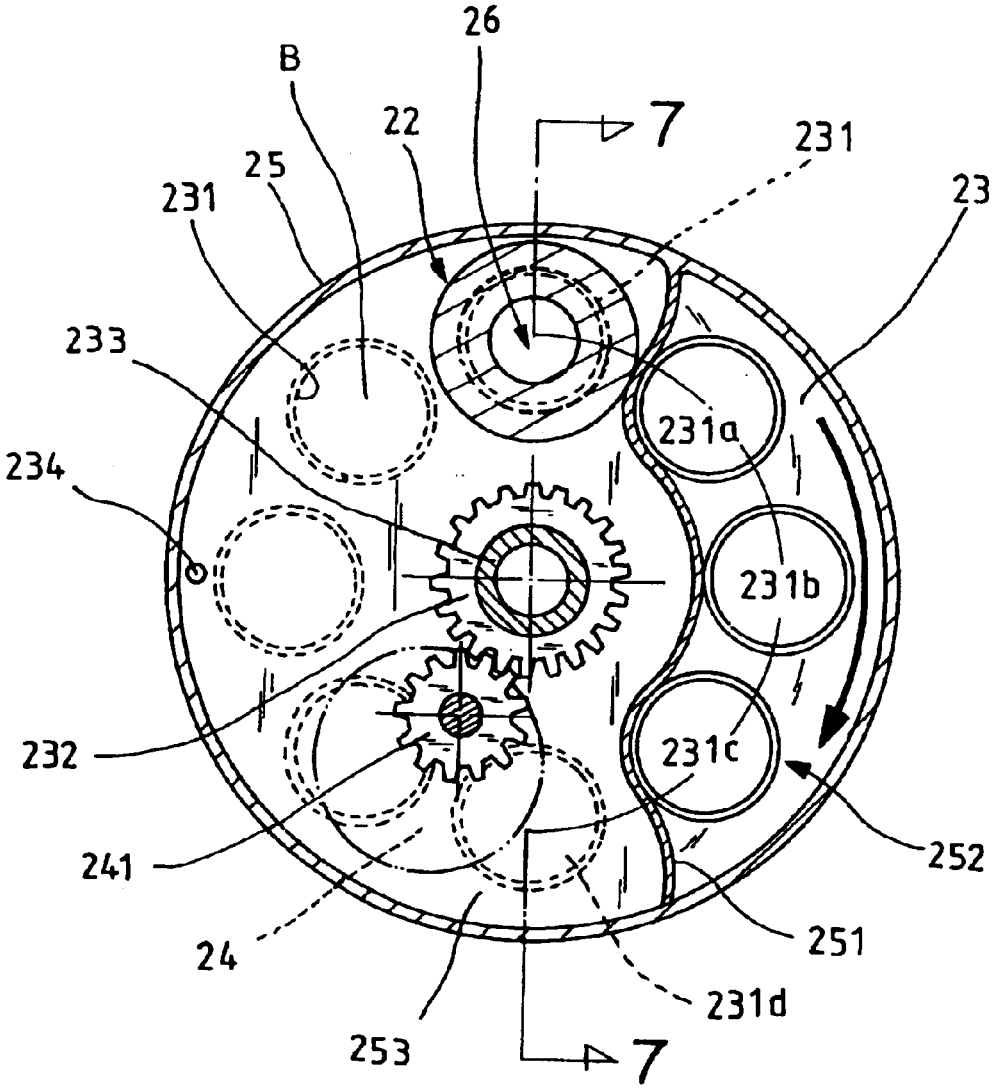
FIG. 5 is a cutaway view taken along lines 5—5 of FIG. 4.
Figure 6:
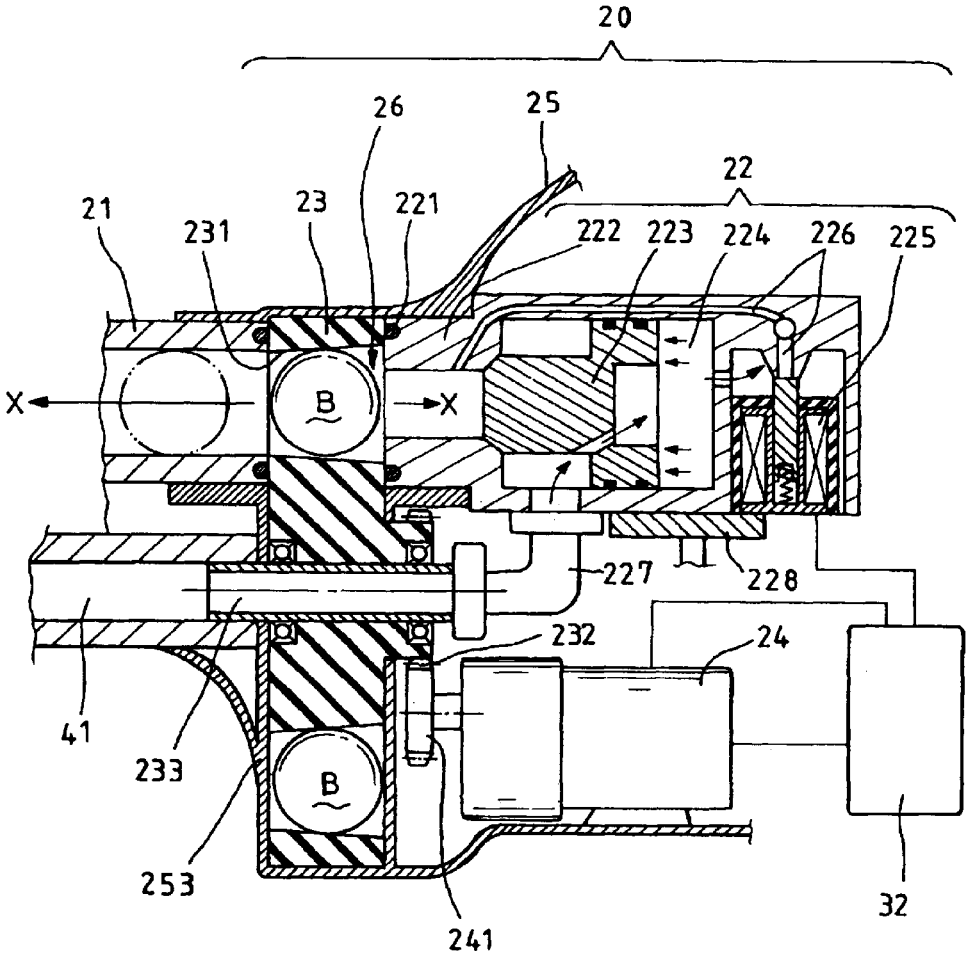
FIG. 6 is a cutaway view taken along lines 6—6 of FIG. 4.
Figure 7:
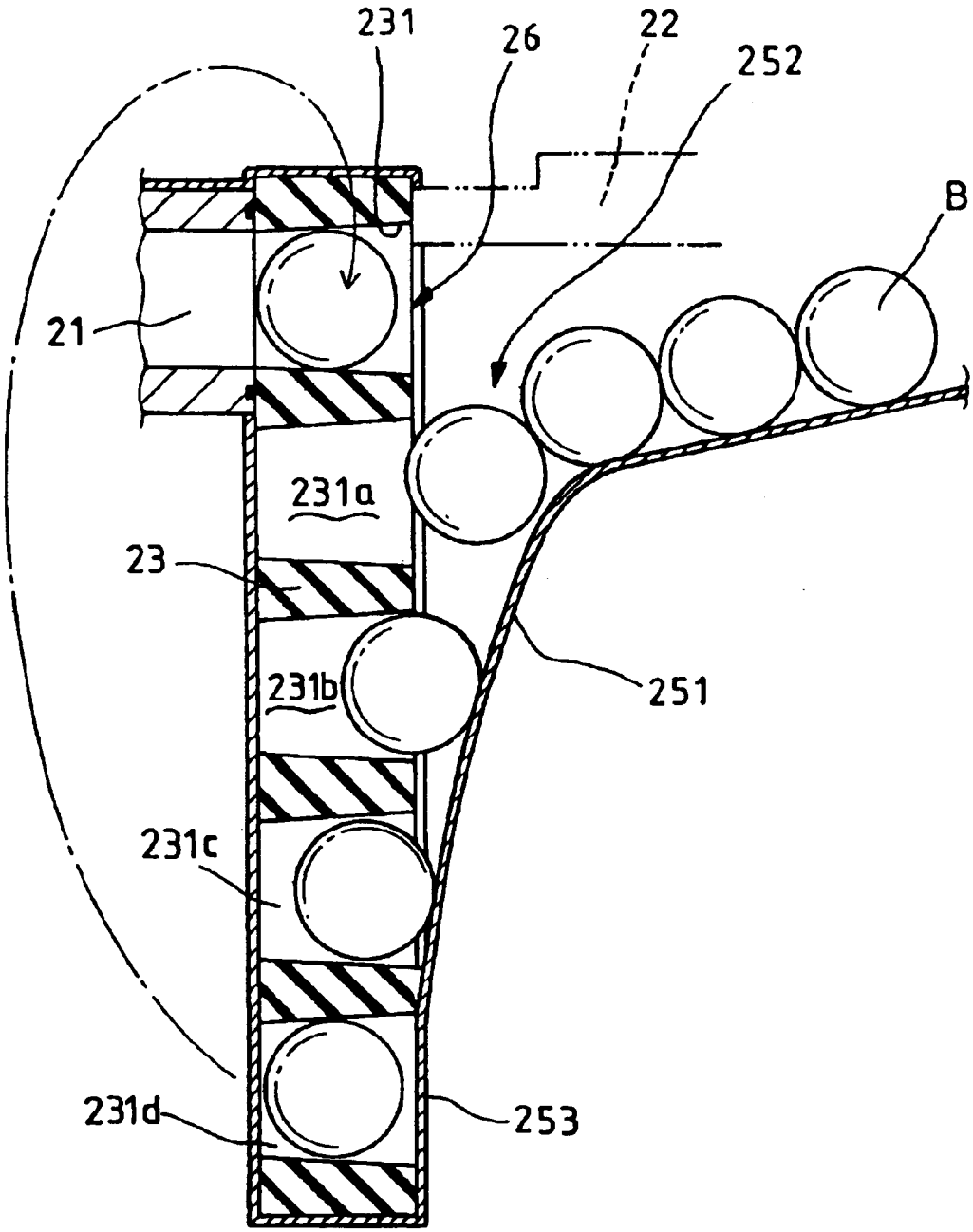
FIG. 7 is a cutaway view taken along lines 7—7 of FIG. 5.

The revolving disc 23, as shown in FIGS. 5 and 6, has 6–8 through holes 231 in a ring-shaped arrangement. Each paintball hole 231 adapted to the diameter of the paintball B has a diameter of 17–18 mm. Thus, the whole diameter of the revolving disc 23 for eight uniformly spaced paintball holes 231 amounts to about 80 mm. The revolving disc 23 is installed within the barrel assembly 20 without influence on the discharge process. The revolving disc 23 is rotatably supported on a central shaft 233 and has a toothed wheel 232 that is disposed at one side of the revolving disc 23 and engages with a transmission gear 241 of the driving apparatus 24. The driving apparatus of the invention 24 consists of a mini-motor and a pneumatic ratchet wheel. Of course, other driving units with the same effect can be employed to impart rotational motion to the revolving disc 23. The driving apparatus 24 is controlled by the firing circuit 32 for precisely rotating the revolving disc 23 at a certain angle (e.g. 45°) to bring the paintballs B in the discharge position. In other words, the paintballs B in the paintball holes 231 can be rapidly and exactly moved to the axial central line X—X (see FIG. 6) of the discharge area 26. In addition, the revolving disc 23 can be additionally fitted with a locating sensor 234 to achieve a more precise positioning effect.

The firing mechanism 22 for paintguns has different types. Based on the firing mechanism 22 of the U.S. Pat. No. 6,601,780, the firing mechanism 22 of the invention includes an air feeding pipe 222. The air feeding pipe 222 with a sealing ring 221 at the front end thereof is pressed against the inner side of the discharge area 26 of the revolving disc 23 for achieving a sealed state. A piston body 223 within an air pressure chamber 224 is shiftable. Besides, a solenoid valve 225 is provided for opening and closing an air flow channel 226 so as to ensure a pressure balance of the air flowing through the air inlet pipe 41 and the bore of the central shaft 233 and entering into an air inlet aperture 227. In this way, the piston body 223 is moved to open or close the air feeding pipe 222 for controlling the discharge of the paintballs B. Instead of the central shaft 233, it's possible to have the pressured air pass through another channels to reach the air inlet aperture 227.

When the solenoid valve 225 is actuated, the air flow channel 226 is opened to let a small amount of airflow pass through the air flow channel 226 into the air feeding pipe 222 first, thereby pushing the paintball slightly forward and preventing it from exposure to the swarming air that breaks the paintball B in pieces when the piston body 223 is opened. Moreover, the firing mechanism 22 is mounted on a positioning seat 228 within the barrel assembly 20 such that the firing mechanism 22 is rigidly positioned in front of the discharge area 26.

As the driving apparatus 24, the solenoid valve 225 is also controlled by the firing circuit 32. By pulling the trigger 31, as shown in FIG. 3, a microswitch or a sensing element of the firing circuit 32 is actuated to enable the driving apparatus 24 to rotate the revolving disc 23 in position.

Thereafter, the release of the solenoid valve 225 allows a large amount of airflow to swarm into the air feeding pipe 222 for firing the paintball B of the paintgun.

Unlike the prior art in which the paintballs fall to the discharge area by the gravity, the discharge rate of the invention can be therefore improved due to the fact that the paintballs B is rapidly brought in discharge position by rotating the revolving disc and the air feeding pipe 222 is directly positioned against the surface of the discharge area 26 without reciprocating motion In order to ensure a smooth feeding process of the paintballs B into the revolving disc 23, the paintball container 25 includes a guiding slope 251 for guiding the paintball B within the paintball container 25 to a feeding area 252 where the paintballs B are fed into the paintball holes 231. Besides, the guiding slope 251 serves to separate the firing mechanism 22 from the driving apparatus 24. As shown in FIG. 5, the paintballs B are fed through the guiding slope 251 into the paintball holes 231*a*, 231*b*, 231*c*, 231*d* one after another and then enter a housing 253 of the revolving disc 23. Accordingly, at least four paintballs B are kept in the housing 253 readily available for discharge. Therefore, the invention ensures a rapid feeding process.

Except the paintball holes 231 that are located at the inner side of the feeding area 252 and the internal and the external side of the discharge area 26, the other paintball holes 231 are positioned within the housing 253.

Figure 8:
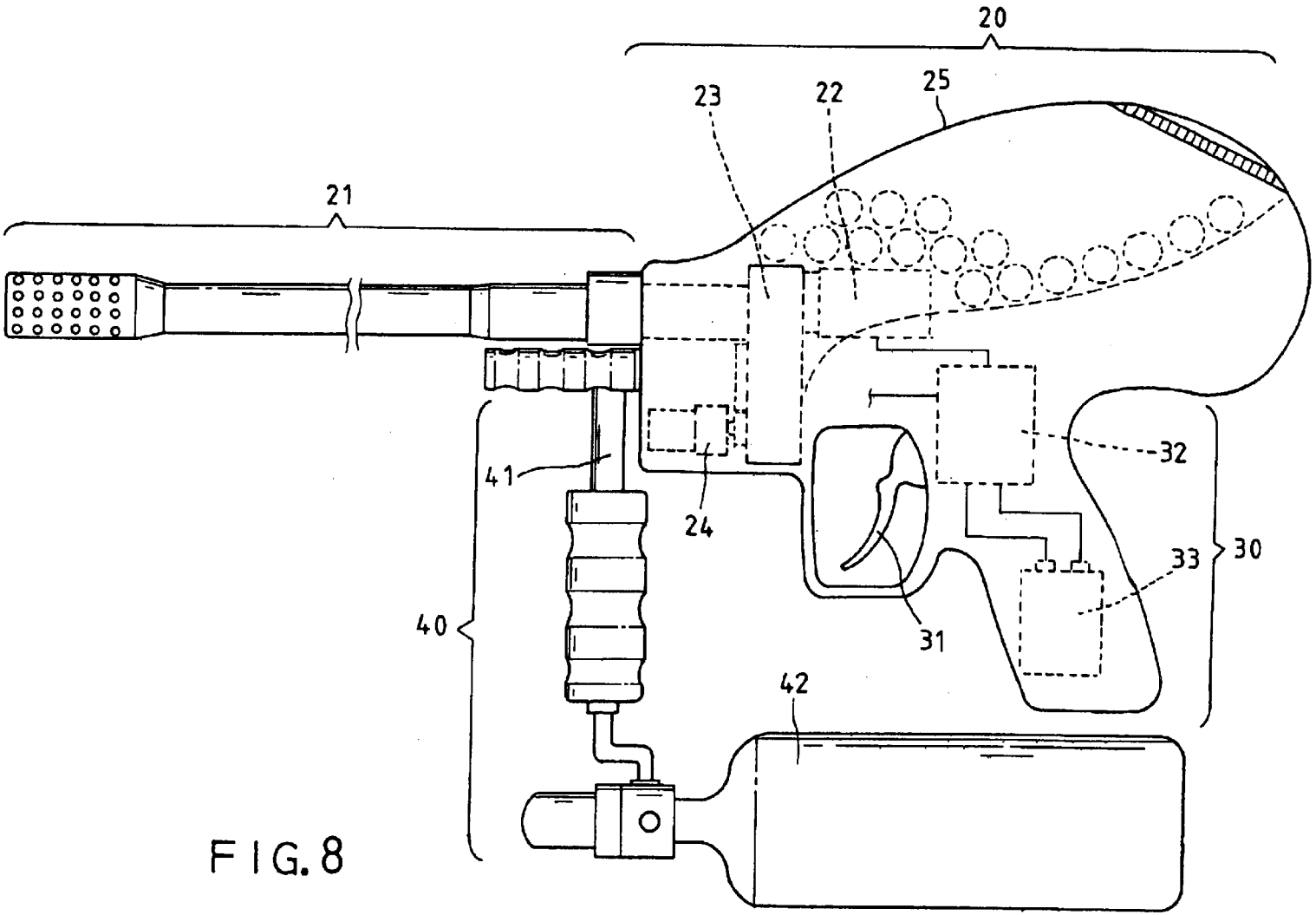
FIG. 8 is a schematic drawing of another embodiment of the invention.
Figure 9:
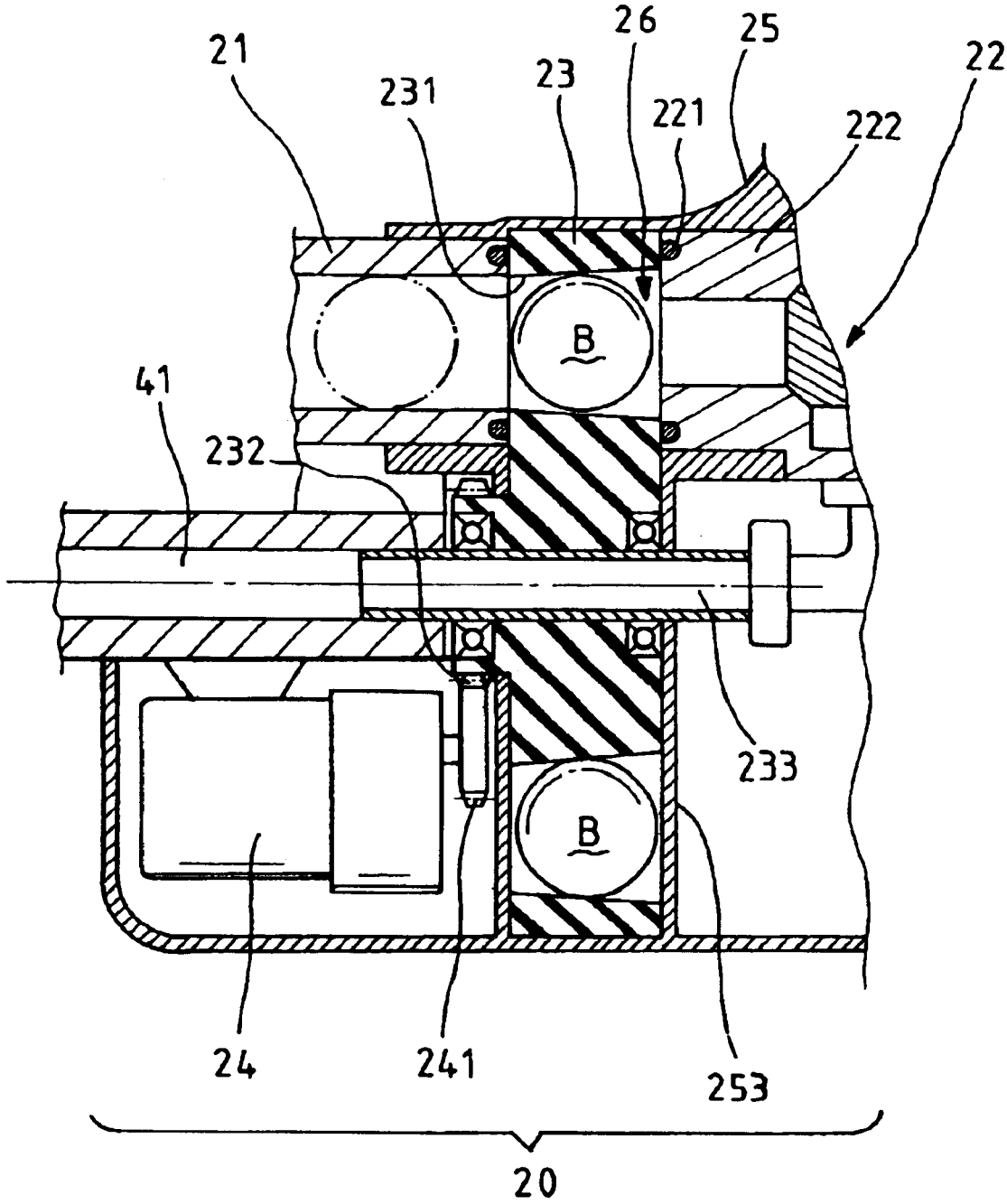
FIG. 9 is a partial sectional view of the paintgun shown in FIG. 8.

Referring to FIGS. 8 and 9, another embodiment of the invention is shown. In this embodiment, the toothed wheel 232 and the driving apparatus 24 are installed at the external side of the revolving disc 23. Meanwhile, the transmission gear 241 imparts rotational motion to the revolving disc 23. This embodiment has the same transmission way as the aforementioned embodiment, and shows an alternative design for the invention. In addition, it is beneficial in servicing the driving apparatus 24.

Figure 10:
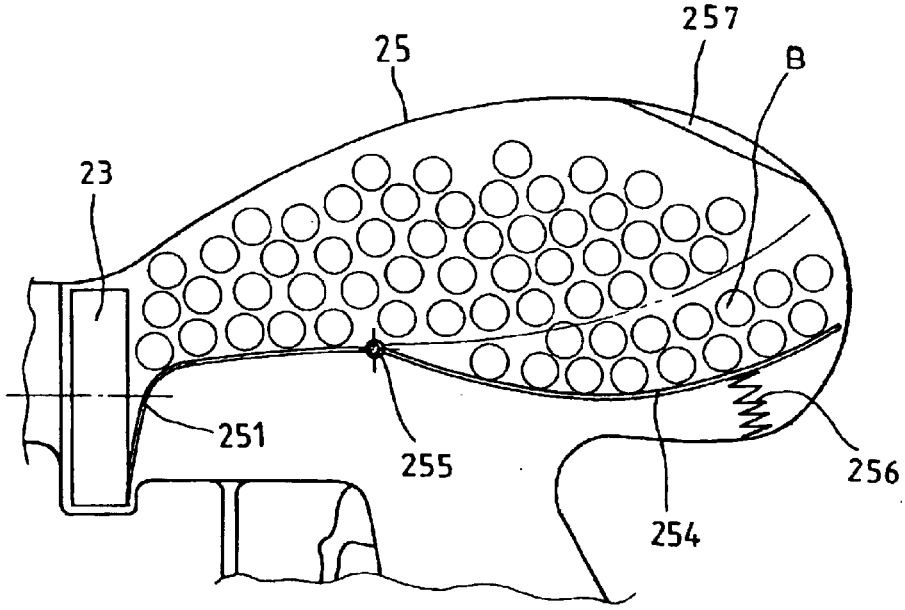
FIG. 10 is a schematic drawing of a paintball container of the invention in an alternative design with its bottom supported by a compression spring in a compressed state.
Figure 11:
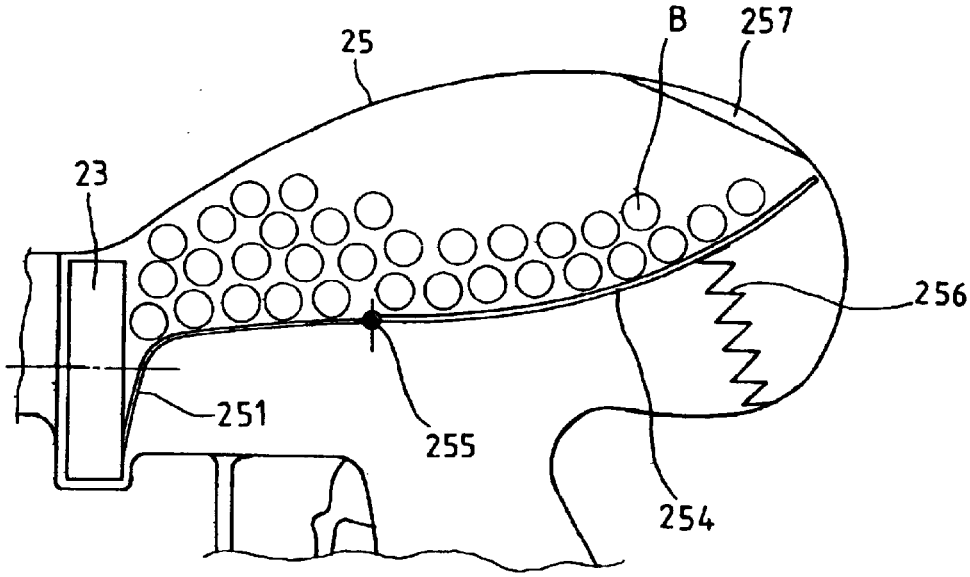
FIG. 11 is a schematic drawing of the paintball container shown in FIG. 10 with its bottom raised by the compression spring in a released state.

As shown in FIG. 10 and 11, the bottom of the paintball container 25 is formed with a supporting surface 254 that meets the guiding slope 251 and is swiveled on a pivot 255. Meanwhile, the supporting surface 254 is supported by a compression spring 256. When the paintball container 25 is filled with the paintballs B, the resilience of the compression spring 256 is overcome by the weight of the paintballs B such that the supporting surface 254 is lowered to increase the storage space of the paintball container 25. When the paintballs B are gradually discharged, the supporting surface 254 rises due to the resilient force of the compression spring 256, thereby forming a smooth slope to bring the paintballs B to the guiding slope 251. In spite of the arrangement of the paintball container 25 in the barrel assembly 20, the accommodating capacity is not reduced. Besides, the paintball container 25 further includes a filling hole 257 that is in position lower than that of the conventional paintguns, thereby facilitating the filling action in simulated games of gun battle.

Figure 12:
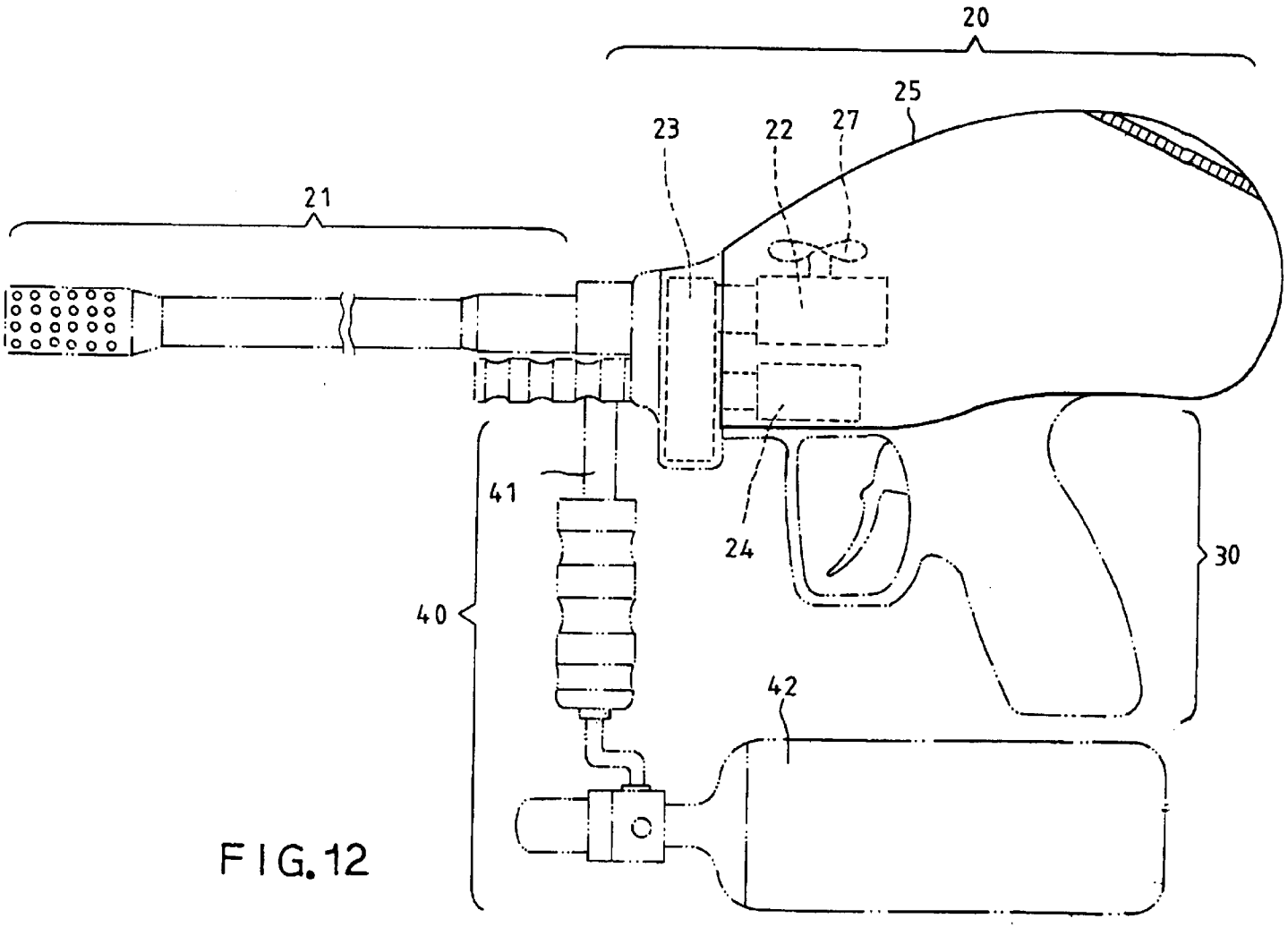
FIG. 12 is a schematic drawing of a paintball container of a further embodiment of the invention.

Unlike the paintball container 25 and the barrel assembly 20 that are integrated in a body in accordance with the embodiment shown in FIGS. 10 and 11, the paintball container 25, as shown in FIG. 12, is formed as a detachable housing that is attached to the barrel assembly 20 to cover the components within the barrel assembly 20. If necessary, the paintball container 25 is detachable from the barrel assembly 20 for a convenient maintenance and repair of the firing mechanism 22, the revolving disc 23 and the driving apparatus 24. Certainly, the inside of the paintball container 25 is provided with a stirrer 27 for evenly distributing the paintballs B to allow a smooth feeding of the paintball B. This kind of stirrer 27 also belongs to the prior art so that no further descriptions thereto are given hereinafter.

Based on the aforementioned technique and means, problems that the paintballs are stuck, hemmed and broken don't arise any more. Meanwhile, the feeding speed of the paintballs can be improved and the shooting sights won't be restricted.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A paintgun comprising:

a) a barrel assembly having a barrel at the front end of thereof and a firing mechanism for paintballs;

b) a trigger assembly connected with the barrel assembly for actuating the firing mechanism;

c) a pneumatic delivery mechanism for supplying pressurized air required by the firing mechanism;

d) a revolving disc for feeding paintballs interposed between the barrel and the firing mechanism, a series of uniformly spaced paintball holes being formed at the rim of the revolving disc, the revolving disc being rotated by a driving apparatus having a transmission gear to bring the paintballs within the paintball holes to a discharge area coaxial to the barrel for firing the paintgun, the revolving disc being rotatable supported on a central shaft and having a toothed wheel that is disposed at one side of the revolving disc and engaged with the transmission gear of the driving apparatus; and e) a paintball container for storing the paintballs disposed adjacent to the revolving disc and the firing mechanism within the barrel assembly, the paintball container having a guiding slope at a bottom thereof for directing the paintballs into the paintball holes of the revolving disc, the revolving disc with the paintballs being rotatable one after another to the discharge area.

2. The paintgun as recited in claim 1, wherein the driving apparatus consists of a mini-motor and a pneumatic ratchet wheel.

3. A paintgun comprising:

a barrel assembly having a barrel at the front end of thereof and a firing mechanism for paintballs;

b) a trigger assembly connected with the barrel assembly for actuating the firing mechanism;

c) a pneumatic delivery mechanism for supplying pressurized air required by the firing mechanism;

d) a revolving disc for feeding paintballs interposed between the barrel and the firing mechanism, a series of uniformly spaced paintball holes being formed at the rim of the revolving disc, the revolving disc being rotated by a driving apparatus to bring the paintballs within the paintball holes to a discharge area coaxial to the barrel for firing the paintgun; and e) a paintball container for storing the paintballs disposed adjacent to the revolving disc and the firing mechanism within the barrel assembly, the paintball container having a guiding slope at a bottom thereof for directing the paintballs into the paintball holes of the revolving disc, the revolving disc with the paintballs being rotatable one after another to the discharge area, the bottom of the paintball container being formed as a supporting surface that meets the guiding slope and is swiveled on a pivot, and wherein the supporting surface is supported by a compression spring.

4. The paintgun comprising:

a) a barrel assembly having a barrel at the front end of thereof and a firing mechanism for paintballs;

b) a trigger assembly connected with the barrel assemble for actuating the firing mechanism;

c) a pneumatic delivery mechanism for supplying pressurized air required by the firing mechanism, d) a revolving disc for feeding paintballs interposed between the barrel and the firing mechanism, a series of uniformly spaced paintball holes being formed at the rim of the revolving disc, the revolving disc being rotated by a driving apparatus to bring the paintballs within the paintball holes to a discharge area coaxial to the barrel for firing the paintgun; and e) a paintball container for storing the paintballs disposed adjacent to the revolving disc and the firing mechanism within the barrel assembly, the paintball container having a guiding slope at a bottom thereof for directing the paintballs into the paintball holes of the revolving disc, the revolving disc with the paintballs being rotatable one after another to the discharge area, the firing mechanism including an air feeding pipe, the air feeding pipe having a sealing ring at a front end thereof being pressed against the inner side of the discharge area of the revolving disc, and wherein a piston body within an air pressure chamber is shiftable, and wherein a solenoid valve is provided for opening and closing an air flow channel.

* * * * *